US005707277A

United States Patent [19]

Jakubowski

[11] Patent Number: 5,707,277

[45] Date of Patent: Jan. 13, 1998

[54] UNITARY INTERNAL/EXTERNAL EXTENSION PLATE FOR A JIG GRINDER

[75] Inventor: Paul Jakubowski, West Chicago, Ill.

[73] Assignee: Tri-Tool & Die Co., West Chicago, Ill.

[21] Appl. No.: 739,126

[22] Filed: Oct. 28, 1996

[51] Int. Cl.[6] ..... B24B 21/18; B24B 33/00; B24B 47/26; B24B 55/00

[52] U.S. Cl. ..... 451/442; 451/440

[58] Field of Search ..... 409/111, 112, 409/122, 123, 130, 144, 143; 451/911, 419, 415, 423, 442, 435, 437, 440, 441, 360, 361

[56] References Cited

U.S. PATENT DOCUMENTS 2,266,113 12/1941 Wiss ..... 451/440

2,715,806 8/1955 Hancock, Jr. ..... 451/437

2,845,757 8/1958 Grewe et al. ..... 451/435

OTHER PUBLICATIONS

L.G. Evans Catalog, pp. 1, 2 and 4.

*Primary Examiner*—James G. Smith

*Assistant Examiner*—Derris H. Banks

*Attorney, Agent, or Firm*—Hill, Steadman & Simpson

[57] ABSTRACT

A single unitary reversible precision tool accessory for a jig grinder constituted by a extension plate which extends selectively either the internal or the external grinding capacities of a jig grinder machine.

6 Claims, 3 Drawing Sheets

UNITARY INTERNAL/EXTERNAL EXTENSION PLATE FOR A JIG GRINDER

FIELD OF THE INVENTION

This invention relates generally to jig grinders and more particularly to a precision tool accessory comprising a unitary extension plate which is reversible for grinding the inside diameters or the outside diameters of large holes.

THE PRIOR ART

The field of jig design relates to the planning of tools for use in making production parts. Thus, jigs are utilized for positioning parts during the course of machine operations such as drilling, milling, reaming, and boring, and such jigs physically guide the cutting or grinding tools.

The accuracies obtained by jigs or fixtures are dependent upon the accuracy with which the parts can be consistently positioned in the jigs or fixtures. Thus, the dimensional consistency of the part itself is a factor. One desirable practice is to have a jig create locating points which should be used for as many operations as possible.

Grinding machines are designed to hold a work piece rigidly and to effect relative motion of the work piece and a rotating grinding wheel. Grinding machines used in the construction of precision dies must have sufficient accuracy to produce finely finished surfaces and close dimensional tolerances. For example, in the use of a jig grinder in the environment of the present invention, it is not at all unusual to expect the jig grinder to produce an accuracy up to 50 millionths of an inch. Cylindrical grinding is performed on the peripheries or shoulders of work pieces composed of concentric cylindrical or eonical shapes. However, where the particular work piece is large, it may be necessary to extend the range of the jig grinder machine by the use of a precision tool accessory known as a so-called extension plate.

Heretofore, separate extension plates have been available as jig grinding accessories, for example, as an accessory for a Moore precision tool jig grinder. With such accessories, there is available an internal extension plate which extends the normal range of hole grinding to 10 and ½ inches (266 mm) diameter on all Moore jig grinders when using a 1½" (38 mm) diameter wheel.

A separate and independent external extension plate is also available which places the grinding head behind center enabling the wheel to be fed from grind side on diameters up to 7¾ inches (196 mm) O.D. when using a 1" (25 mm) diameter wheel.

Precision Tool Accessories for Moore brand jig grinders also include a special extension plate which is designed for internal grinding and wherein grinding is permitted of a 13 ½" (342 mm) diameter hole when using a 1½" (38 mm) diameter wheel.

SUMMARY OF THE PRESENT INVENTION

According to the present invention, a single unitary precision tool accessory extension plate takes the place of two plates needed currently to extend the internal and external grinding capacities of a jig grinder. When positioned on the internal (I.D.) side, the normal range for hole grinding is extended, for example, to 10½ inches. The same identical plate is merely reversed, or inverted, whereupon the plate is used on the external (O.D.) side of the plate whereupon the grinding head behind center allows the grinding wheel to be fed from the grind side on diameters up to 7¾ inches. It will be understood that variations may be effected in the size of the unitary extension plate to accomplish different selected extensions, if desired.

DESCRIPTION OF THE PREFERRED EMBODIMENTS

Figure 1:
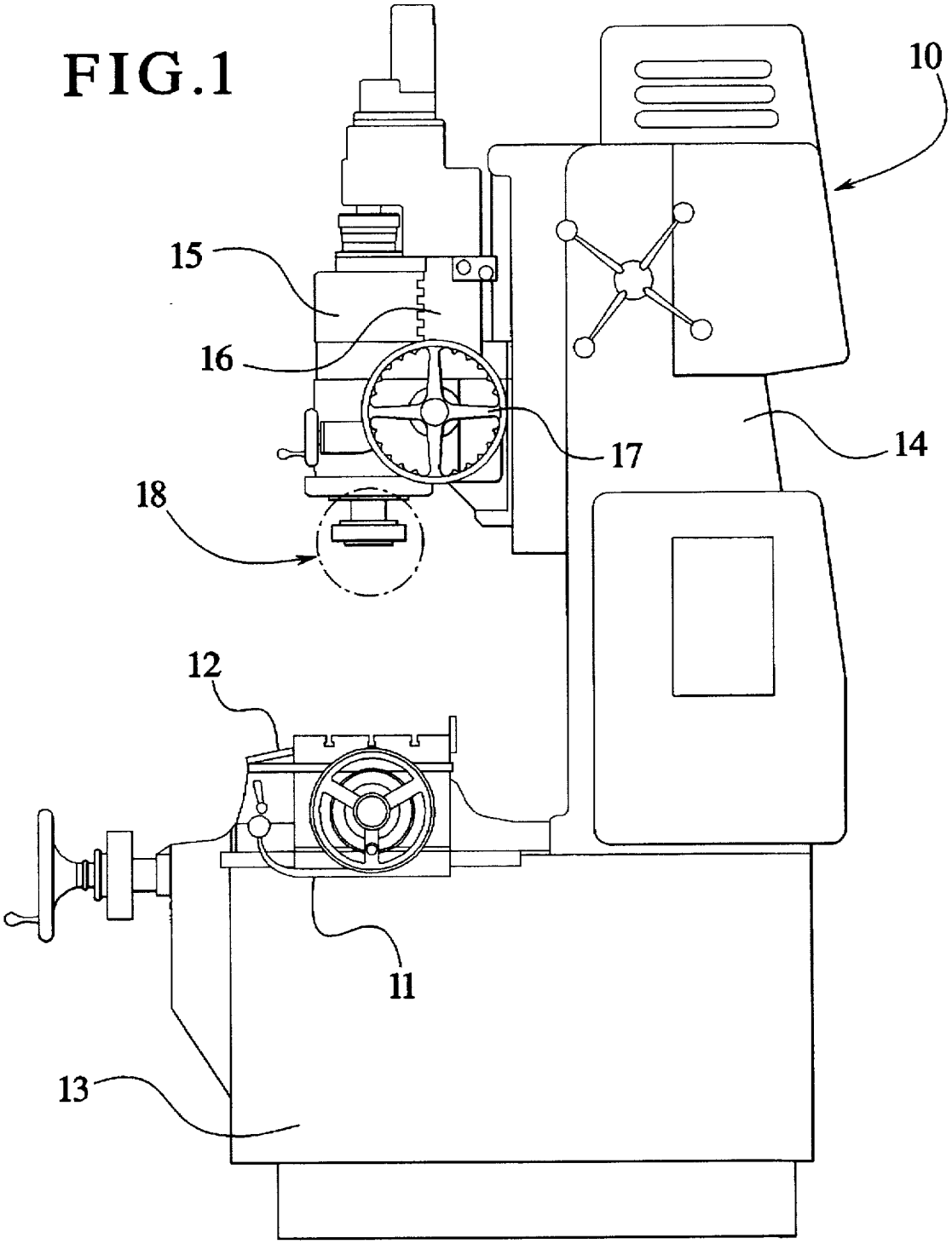
FIG. 1 is an outline drawing of a jig grinding machine with which the extension plate of the present invention may be utilized.

A typical jig grinder machine which forms the environment in which the present invention finds its greatest utility is depicted in an outline and foundation layout as set forth in FIG. 1. Referring to FIG. 1, the jig grinder machine is shown generally at 10 having the usual table 11 on which is mounted a cross slide assembly 12. The machine is mounted on a foundation frame 13 having an upright column 14 and which carries a vertical slide 15 movable on a track 16 and controlled by an adjustment wheel 17.

Figure 2:
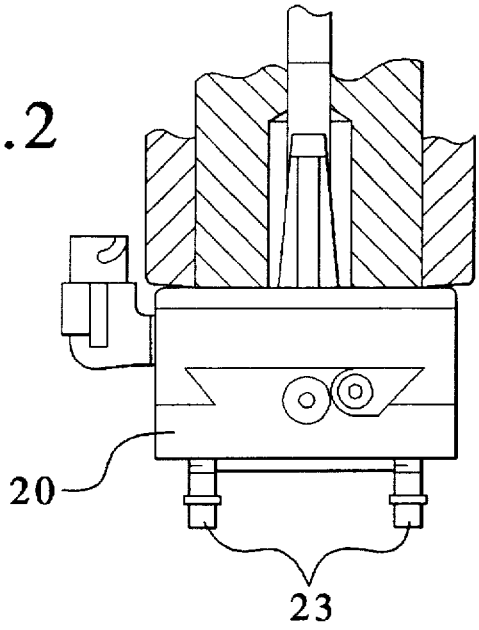
FIG. 2 is a fragmentary view with parts broken away and with parts shown in cross-section constituting details of a dove tail slide sub assembly to which the extension plate of the present invention is connected on the jig grinding machine of FIG. 1.
Figure 3:
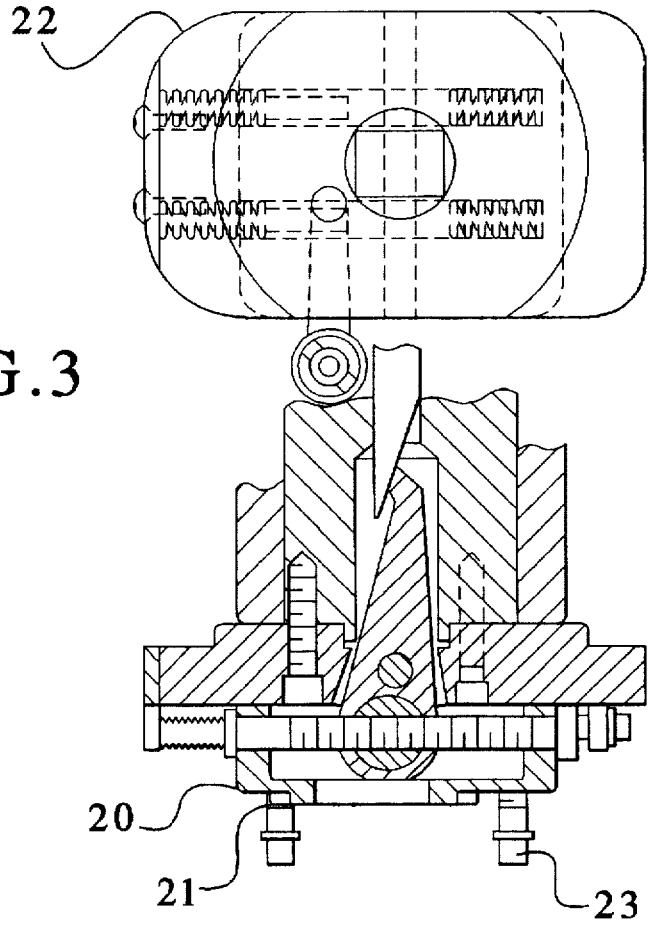
FIG. 3 is a cross-sectional view with parts shown in elevation of the dove tail slide sub-assembly of FIG. 2.

The machine is provided with a dove tail slide shown generally at 18 on FIG. 1, the details of which are more clearly depicted in FIGS. 2 and 3.

A dove tail way is shown at 20 and carries an eccentric 21.

A spring plate is shown at 22. The eccentric ring has a plurality of mounting screws shown at 23 by means of which an extension plate can be connected to the dove tail slide.

In accordance with the principles of the present invention a unique single unitary one piece reversible precision tool accessory extension plate is provided for use with a jig grinder machine 10 thereby obviating the need for separate extension plates while permitting the selective extension of the grinding capacities of the jig grinding machine for both internal diameter holes and external diameter holes. Extension plates must be necessarily highly accurate devices which are expensive to make and highly accurate for their intended purpose.

Figure 4:
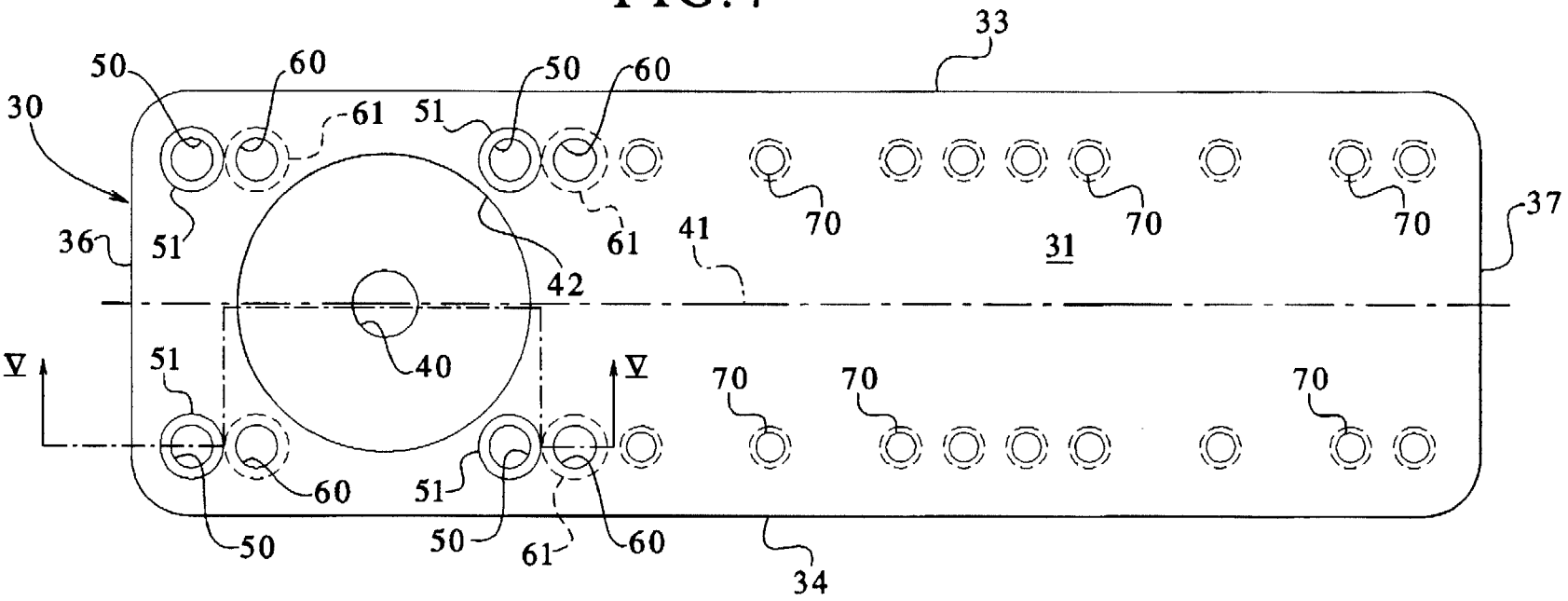
FIG. 4 is a plan elevational view of one side of the extension plate provided in accordance with the principles of the present invention.
Figure 5:
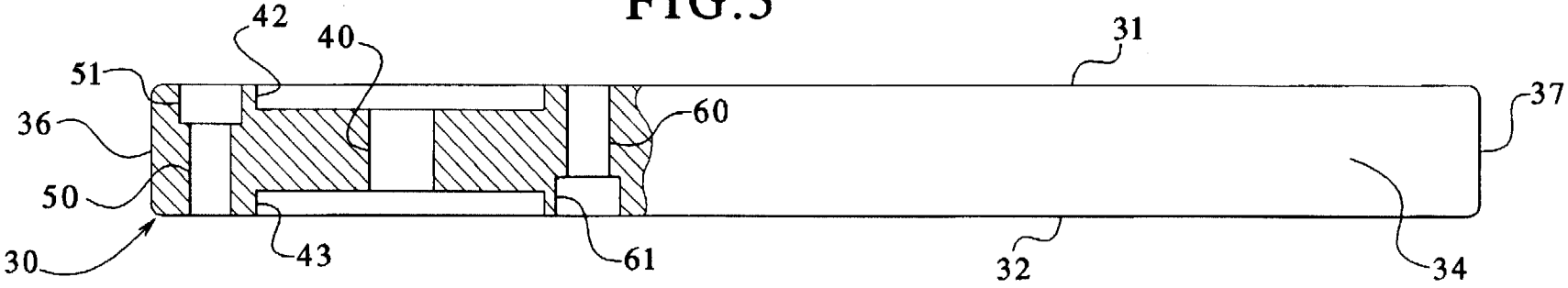
FIG. 5 is a fragmentary cross-sectional view taken on line V—V of FIG. 4.

Referring to FIGS. 4 and 5, it will be noted that the single unitary one piece reversal extension plate of the present invention is shown generally at 30 and constitutes a generally rectangular metal plate having opposite parallel sides forming a first surface 31 and second surface 32. The surfaces 31 and 32 are generally rectangular in configuration and are bounded by longitudinally extending side walls 33 and 34 and transversely extending end walls 36 and 37.

The first surface 31 on a first side of a plate 30 is adapted for grinding internal diameter holes while the second surface 32 on the second side of the plate 30 which is parallel and opposite to the first surface as adapted for grinding external diameter holes.

In order to accomplish such capability in a single unitary reversible precision tool element, the plate 30 of the present invention is formed with a through opening 40 disposed inwardly of the end wall 36 and preferably on the longitudinal center line axis 41.

Each of the first and second surfaces 31 and 32 are formed to provide a cylindrical concentric recess counter-bore relative to the through opening 40, the counterbored recess in the surface 31 being shown at 42 and the counterbored recess in the surface 32 being shown at 43.

There is thus provided a means to receive the driving eccentric 21 regardless of which side of the plate 30 is connected to the dove tail slide 18.

In order to supply a connecting means for fastening the plate 30 to the dove tail slide in firm assembly therewith, first and second sets of counterbored drilled through holes are provided in corresponding of said first and second surfaces 31 and 32. Thus, with respect to the first surface 31, there is provided a set of four drilled through holes shown at 50, each of which is counterbored at 51. It will be noted that each of the holes 50 and its corresponding counter-bore 51 is disposed symmetrically with respect to the center line axis 41 and the holes 50 are also disposed outwardly of the recess 42 in which the eccentric 21 is received.

On the opposite side of the plate 30, the surface 32 is formed with a separate set of drilled through holes and such holes are also 4 in number and are shown at 60. The holes 60 are counterbored in the surface 32 and such counterbores are shown at 61.

It will be noted that each of the holes 60 and its respective corresponding counterbore 61 are offset longitudinally along the length of the plate 30 in the direction of the longitudinal center line axis 41 so that they are disposed in a pre-aligned keyed location, thereby to insure that the plate 30 can never be fastened in place improperly without a specific intention to selectively extend the internal or the external grinding capacity of the jig grinder machine 10.

Lastly, a plurality of tapped recesses 70 are formed in each of the first and second surfaces 31 and 32 and are disposed in rows and columns at spaced apart intervals for effecting selective engagement of the extension plate 30 with a grinding tool. (Not shown).

In use, whenever it is desired to grind large holes on either inside or outside diameters, the single unitary plate 30 can be selectively used either in one position or the other depending on the type of grinding extension desired, whereupon the normal range of hole grinding will be selectively enhanced and the operator can effect such extension selectively with only a single unitary extension plate.

Although minor modifications might be suggested by those versed in the art, it will be understood that I wish to embody within the scope of the claims set forth herein all such modifications as reasonably and properly come within the scope of my contribution to the art.

What is claimed is:

1. A unitary one-piece precision tool accessory to selectively extend either the internal or the external grinding capacities of a jig grinder machine comprising;

an elongated generally rectangular extension plate having:

(1) a first surface on a first side of said plate adapted for grinding internal diameter holes, (2) a second surface on a second side of said plate parallel and opposite to said first surface and adapted for grinding external diameter holes, (3) longitudinally extending parallel side walls spaced apart from one another laterally, (4) transversely extending parallel end walls spaced apart from one another longitudinally, said plate member having formed therein a through opening disposed inwardly of one of said end walls and each of said first and second surfaces having formed therein a cylindrical concentric recess counterbored relative to a corresponding side of said through opening, thereby to selectively receive a driving eccentric of a dove tail slide on a jig grinder machine, and first and second sets of counterbored drilled through holes in corresponding of said first and second surfaces and by means of which said plate may be connected in firm assembly with the dove tail slide of the jig grinder machine, each set of said first and second sets of counterbored drilled through holes being disposed in a pre-aligned keyed location, and a plurality of tapped recesses in said first and second surfaces disposed in rows and columns for effecting selected engagement with a grinding tool.

2. For use with a jig grinder machine of the type having a dove tail slide to which grinding tools may be selectively connected, the improvement of:

a single unitary one-piece reversible extension plate to selectively attach to the dove tail slide for extending the grinding capacities of the jig grinding machine for both internal diameter holes and external diameter holes.

3. The invention of claim 2 wherein said extension plate more particularly comprises:

a rectangular body made of metal and having opposite sides forming flat first and second surfaces, said body having longitudinally extending side walls and transversely extending end walls, one of said surfaces being adapted to extend the grinding capacities of the jig grinder machine for internal diameter holes and the other of said surfaces being adapted to extend the grinding capacities of the jig grinder machine for external diameter holes.

4. The invention of claim 3 wherein said extension plate is further characterized by first and second sets of counterbored drilled through holes being formed in corresponding of said first and second surfaces and by means of which said plate may be selectively connected in firm assembly with the jig grinding member.

5. The invention of claim 4 wherein each of said first and second sets of counterbored drilled through holes are formed in different pre-aligned keyed locations corresponding to inside and outside diameter positions, respectively.

6. The invention of claim 5 and a plurality of tapped recesses in each of said first and second surfaces disposed in rows and columns for effecting selective engagement with a grinding tool.

* * * * *